United States Patent [19]

Moudgil et al.

[11] 4,169,045

[45] Sep. 25, 1979

[54] SEPARATION OF SHALE FROM WASTE MATERIAL

[75] Inventors: Brij M. Moudgil, Ontario; David F. Messenger, Pomona, both of Calif.

[73] Assignee: Occidental Research Corporation, Irvine, Calif.

[21] Appl. No.: 897,739

[22] Filed: Apr. 19, 1978

[51] Int. Cl.[2] ..... B07C 5/02; B07C 5/342

[52] U.S. Cl. ..... 209/3.3; 209/578

[58] Field of Search ..... 209/3.1, 3.2, 3.3, 1, 209/3, 4, 9, 578

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson et al. | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1976 | Sawyer | 209/3.1 |
| 3,992,287 | 11/1976 | Rhys | 209/2 |

*Primary Examiner*—Allen N. Knowles
*Attorney, Agent, or Firm*—B. Bisson

[57] ABSTRACT

A method is disclosed for the separation of shale from run of mine (ROM) shale containing particles of shale and refuse, which comprises conditioning the ROM shale with a coupling agent capable of selectively coating the kerogen hydrocarbons in the particulate shale to the substantial exclusion of coating the non-hydrocarbonaceous refuse, which coupling agent is at least one carboxylic acid, preferably containing from about 5 to about 28 carbon atoms and a ketone. Combined with said coupling agent is a fluorescent dye in a quantity to make the coated particles of shale fluoresce upon excitation to a degree sufficient to distinguish the coated shale particles from the substantially non-coated refuse. Exciting (e.g. as with ultraviolet light) the fluorescent dye coupled to the shale particles induces fluorescence and enables separating the fluorescing, coated shale particles from substantially non-fluorescing, non-coated refuse particles.

14 Claims, No Drawings

SEPARATION OF SHALE FROM WASTE MATERIAL

BACKGROUND OF THE INVENTION

The present invention relates to a method for the separation of shale from ROM shale. More particularly, it relates to a method for separating shale from slate, shale, limestone, fireclay, and boney shale present in ROM shale.

As presently mined, ROM shale contains many impurities such as slate, shale, limestone, fireclay, and boney shale in varying concentrations. These and various other impurities in the ROM shale are hereinafter referred to as refuse. There are no economically practical techniques for separating shale from refuse, or separating higher grade shale from lower grade shale. It should be noted that the term "oil shale" as used in the industry is in fact a misnomer; it is neither shale, nor does it contain oil, it is a sedimentary formation comprising marlstone deposit and including dolomite with layers containing an organic polymer called "kerogen," which, upon heating, decomposes to produce liquid and gaseous products. It is the formation containing kerogen that is called "oil shale" herein, and the liquid carbonaceous product is called "shale oil."

SUMMARY OF THE INVENTION

In accordance with the present invention, there is provided a method for the separation of higher grade shale from ROM shale containing particles of higher grade shale, lower grade shale and refuse, which comprises conditioning the ROM shale (or any lower grade shale) with a coupling agent capable of selectively coating the particulate shale to the substantial exclusion of coating refuse, which coupling agent is at least one carboxylic acid, preferably containing from about 5 to about 28 carbon atoms, and a ketone. Also added, preferably combined with said coupling agent, is a fluorescent dye in a quantity to make the coated particles of shale fluoresce upon excitation to a degree sufficient to distinguish the higher grade coated shale particles from the lesser coated, lower grade shale particles and the substantially non-coated refuse. The fluorescent dye coupled to the shale particles is excited to induce fluorescence and the fluorescing, higher grade coated shale particles are separated from the substantially non-fluorescing, refuse particles and the lesser intensity fluorescing, lower grade shale particles.

In some cases, a dye can be used which is not fluorescent, but which has a visable color and separation can be done by optical means including valve sorting.

As used herein, "higher grade" and "higher BTU" mean particles of economically significantly greater kerogen or "oil" content or fuel oil (or carbon, including hydrocarbon, content) as compared to "lower grade" or "lower BTU" shale or "refuse" (which has substantially no economic value as source of oil.) It is to be understood that the distinction between higher and lower grade or BTU or oil content is a matter of economic choice. Once the economic choice (e.g. of a minimum BTU particle) is made, the sorting apparatus can be set to separate particles which possess a higher or lower fluorescent intensity than that chosen as the "cut-off point" corresponding to the intensity of a particle of the desired minimum oil content.

It should also be understood that the intensity cut-off point can be chosen so as to substantially separate refuse of substantially no fuel value from very low grade shale; however, the economic choice will more frequently be to separate higher oil content from lower oil content particles. For convenience, hereinafter, the process will be described as separation of refuse from ROM shale, but is intended to also describe to one of skill in the art how to separate higher from lower grade shale.

DETAILED DESCRIPTION OF THE INVENTION

According to the present invention, there is provided a method for the separation of refuse from ROM shale to recover shale therefrom. The practice of the method of this invention involves the separation of shale from the refuse present in the ROM shale. The ROM shale to be separated is conditioned with a coupling agent that will selectively coat the shale (or carbonaceous material) in a particle but will not coat the non-carbonaceous refuse. Combined with the coupling agent is a dye, preferably a fluorescent dye that is capable of fluorescence when excited. The fluorescent dye conditioned ROM shale is exposed to electromagnetic radiation to excite the fluorescent dye. The coated shale particles will fluoresce, whereupon they can be separated from the substantially non-coated, non-fluorescing refuse particles.

It should also be understood that a non-fluorescent dye or pigment which has a distinctive color in the visible range can be combined with the coupling agent, whereby the sorting can be done by eye or optical detection apparatus.

The method of the present invention is based upon the differences in surface chemical properties of the material present in ROM shale. Due to these differences, there can be utilized a coupling agent that will substantially, selectively coat only the carbonaceous shale present. By proper selection of coupling agent, the desirable shale in the ROM shale can be separated from the undesirable refuse. Surface chemical properties are relatively more consistent than other properties such as color, reflectance, or conductivity. These other properties tend to be similar for shale and refuse requiring a fine degree of resolution to distinguish between the shale and refuse. Such a degree of resolution is difficult to obtain and, therefore, the efficiency of separation based upon these properties suffers. Separation of material based upon the surface chemical properties is, therefore, more consistent than techniques based upon the above other properties.

To distinguish between the coupling agent coated shale and the non-coated material, there is incorporated with the coupling agent a tagging agent, such as a fluorescent dye. Following coating of the ROM shale with the coupling agent and dye, the ROM shale can be radiated with electromagnetic radiation to cause the dye to fluoresce. The dye coupled with the shale by the coupling agent that is coating the shale will fluoresce to a substantial degree and the non-coated refuse material will essentially not fluoresce, thereby enabling the materials to be separated by differences in fluorescence.

Generally, fluorescence refers to the property of absorbing radiation at one particular wavelength and simultaneously re-emitting light of a different wavelength so long as the stimulus is active. It is intended in the present method to use the term fluorescence to indicate that property of absorbing radiation at one particular wavelength and re-emitting it at a different wavelength, whether or not visible, during exposure to an active stimulus or after exposure or during both these time periods. Thus, fluorescence is used generically herein to include fluorescence and phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the fluorescent dye. Thus, electromagnetic radiation is used generically herein to include electromagnetic radiation and envisions other stimuli that will excite and induce fluorescence of the fluorescent dye.

The choice of a water-soluble or an oil-soluble dye is further described in U.S. patent application Ser. No. 897,740 filed on the same day as the present application, of Brij M. Moudgil, titled "Separation of Limestone from Limestone Ore", (the entire disclosure of which is incorporated herein).

In general, if the coating on the shale (or carbonaceous material) is hydrophobic, an oil-soluble dye would be chosen to cause the shale to fluoresce; however, a water-soluble dye could be applied, which would preferentially coat the refuse in which case the higher grade shale would have a lower intensity and the refuse the higher fluorescence (or visible color).

The method of this invention is practiced in regard to shale by conditioning the ROM shale, following sizing with a coupling agent or mixture of coupling agents that selectively adheres to the kerogen or to the refuse present in the ROM shale. It is preferred to condition the ROM shale with a mixture of coupling agents that selectively coats the carbonaceous matter or kerogen in the ROM shale. The coupling agents that are selective for kerogen are mixtures of a ketone and a carboxylic acid.

In practicing the present method, ROM shale is, in general, first subjected to a crushing step. The ROM shale is crushed to physically separate the shale from the refuse present. Crushing increases the surface area of the particles and further provides a greater surface and reactive site for the coating of the particles by the coupling agent and fluorescent dye. In this crushing step, the ROM shale as mined is crushed to a particle size of from about ¼ to about 8 inches. It is preferred to crush the ROM coal in particle sizes of from about ½ to 3 inches. Particles less than ¼ inch and greater than 8 inches can be used in the practice of the method of this invention. However, the coating and separation of ore particles of less than ¼ inch is less economically attractive and ore particles of greater than 8 inches entrain impurities so as to make the separation process less efficient. Following the crushing and sizing process, the ROM shale can be deslimed to remove soluble impurities and surface fines on the particles.

Following the crushing and desliming steps, the ROM shale is conditioned with a coupling agent selected from a ketone or mixture of ketones and a carboxylic acid or mixture of carboxylic acids, preferably containing from about 6 to about 28 carbon atoms. Preferably, the carboxylic acid is mono-carboxylic, to produce a hydrophobic surface on the carbonaceous material in the particles. It is preferred to select at least one carboxylic acid containing from about 8 to about 18 carbon atoms. Acids of more than about 28 carbon atoms tend to be less selective in coating only the shale particles. Therefore, since acids of more than about 28 carbon atoms are not as selective in coating the particles in the ROM shale, the efficiency of the separation decreases. Acids of less than about 6 carbon atoms will generally be too water-soluble and, thus, can be washed-off and may not attack and hold a sufficient amount of dye.

Coupling agents that are useful in the practice of this method to coat the hydrocarbon present in the shale particles include but are not limited to those selected from a mixture of at least one ketone and at least one member selected from the saturated and unsaturated carboxylic acids including fatty acids which contain from about 5 to about 28 carbon atoms, or a mixture thereof. Carboxylic acids that can be used include palmitoleic acid, oleic acid, linoleic acid, caproic acid, caprylic acid, capric acid, lauric acid, myristic acid, palmitic acid, stearic acid, arachidic acid, behenic acid, tall oil fatty acids and the like.

Suitable ketones (e.g. methylisobutyl ketone) are those which are mutually compatible with the selected carboxylic acid in a selected solvent or dispersant.

The preferred ketones include the ketoacids (e.g., B-acetoacetic acid) and ketones of the general formula $RR^1CO$ where R and $R^1$ can be the same or different and are selected from $C_1$–$C_{24}$ alkyl, $C_6$–$C_{14}$ aryl or alkyl aryl, or $C_5$–$C_{22}$ heterocyclic radicals (e.g. pyridine radical).

The coupling agent is combined with a marking agent, preferably a fluorescent dye, to distinguish coated particles from uncoated particles. Fluorescent dyes known to those skilled in the art and which are compatible with the coupling agents can be used in the practice of the method of this invention. Many such fluorescent dyes are commercially available, such as fluoranthene and fluorescent yellow G. (product of Morton Norwich Chemical, Chicago) rhodamine B, flavine ff, uranine and the like. It is preferred that the fluorescent dye be water-insoluble, especially when the coupling agent is water-insoluble. Water-soluble fluorescent dyes can remain in the dispersant water used during the conditioning of the shale and can, therefore, be entrained in an aqueous surface coating on the refuse as well as combined with the coupling agent coating the shale. Thereby, the efficiency of distinguishing between the shale and refuse would be reduced. The preferred water-insoluble dyes remain combined with the coupling agent and are not attracted to the surface of the refuse particles.

The fluorescent dye can be combined with the coupling agent either before or after the ROM shale is conditioned with the coupling agent. The fluorescent dye can be used in any form, such as a solution, suspension, emulsion, dispersion or alone. The fluorescent dye can be combined with the coupling agent prior to conditioning the ROM shale by either mixing the fluorescent dye directly with the coupling agent or by mixing the fluorescent dye with a suitable diluent or solvent such as an oil, then mixing with the coupling agent. If the fluorescent dye is combined with the coupling agent following the ketone/carboxylic acid mixture conditioning of the ROM shale, it can be applied directly to the conditioned ROM shale or it can be used in one of the above forms such as by mixing the dye with the diluent or solvent, then applying it to the conditioned ore. The fluorescent dye has an affinity toward the coupling agent coating and will, therefore, be attracted to and entrained substantially in only the coated shale particles. Any dye that adheres to the refuse particles, generally, is rinsed off through a wash of the ROM shale. It is preferred to combine the coupling agent and fluorescent dye prior to conditioning the ROM shale. Such prior treatment uses less fluorescent dye, requires fewer steps and is generally more efficient both economically and in separation results.

To condition the ROM shale, the coupling agent is mixed with the sized ROM shale. The coupling agent can be dissolved in a suitable solvent, mixed with a dispersant such as water, or can be used alone. It is preferred to form a dispersion of the coupling agent in water. The aqueous dispersion is then contacted with the ROM shale. Many methods can be employed to contact the dispersion with the ROM shale. Such methods include, but are not limited to, spraying the dispersion onto the particles, passing the particles through a dispersion bath, and the like. It is preferred to spray the ROM shale particles with the dispersion of coupling agent in water. Such a spraying operation can consist of spraying the ROM shale particles as they pass on a belt or shaker bed. The ROM shale can also be passed through a ring sprayer or series of ring sprayers as in Ser. No. 897,946, filed Apr. 19, 1978, concurrently herewith of Moudgil and Roeschlaub, titled "Method and Apparatus for Selective Wetting of Particles", the entire disclosure of which is hereby incorporated herein, to condition and coat the shale particles. The excess dispersion and that physically entrained in the particles can be washed from the ROM shale and used on a subsequent batch. Due to the surface chemical properties of the shale, the coupling agent selectively adheres to the shale and will coat the shale with a coating capable of fluorescence, which will allow the shale to be separated from the refuse present in the ROM shale.

Following the conditioning of the ROM shale, the ROM shale is exposed to electromagnetic radiation to cause the coating on the shale particles to fluoresce. The coated fluorescing particles can be separated from the non-fluorescing particles by many different means, such as by hand or by an optical sorting device such as the Matthews' apparatus taught by Matthews' U.S. Pat. No. 3,472,375, incorporated herein by reference. In the Matthews' apparatus, a free-falling mixture of ore passes in front of a row of detectors. Each detector by proper attenuation is capable of distinguishing between non-fluorescence and fluorescence or in degree of fluorescence. Each detector in turn controls one flowing fluid stream selectively directed transverse to the path of the falling particle, the fluid stream being permitted to impinge only on the properly emitting ore particles. The directed fluid stream deflects the ore particles into a divergent path by which they are separated from the undesired ore particles. Such an apparatus is capable of detecting and separating the coupling agent and dye-coated particles from the non-coated particles.

The invention is further illustrated by the following examples, which are not intended to be limiting.

EXAMPLE 1

A synthetic sample of light brown color oil shale (oil content less than 10 gal/ton) and dark color oil shale (oil content more than 20 gal/ton) was prepared. Both, light brown and dark color oil shale pieces were from Logan Wash #2. Percentage of dark color pieces in the sample was 35%.

After washing, the sample was conditioned with a reagent and a fluorescent dye combination. The reagent in the present case was oleic acid and MIBK (Methyl Isobutyl Ketone) and fluoranthene was used as a fluorescent dye. This mixture was dispersed in water for conditioning purposes. After conditioning, the sample was rinsed with water to remove any mechanically attached reagent. Separation of coated (dark color oil shale) from uncoated (light brown color oil shale) pieces was achieved using Matthews' separator apparatus as shown in U.S. Pat. No. 3,472,375 by passing free-falling particles of the ore in front of a radiating source and subsequently fluorescence detectors. The coated shale particles fluoresced substantially to a greater degree than the refuse when radiated. Each detector had been attenuated to detect the degree of fluorescence of the shale particles and each controlled one flowing fluid stream selectively directed transverse to the path of the falling particles. The fluid streams impinged only on the fluorescing shale particles, The directed fluid stream deflected the fluorescing shale particles on a divergent path from the free-falling, non-fluorescing refuse particles.

Hand sorting results of the separated fractions are summarized below:

| | |
|---|---|
| Reagent used: | Oleic acid + MIBK |
| Fluorescent dye used: | Fluoranthene |
| Component activated: | Dark color oil shale (high grade oil shale) |
| Particle size | 1 to 2 inches |
| Amount of dark color oil shale in the sample | 35% |
| Recovery of dark color rock in concentrate | 79% |
| Amount of light brown color rock in concentrate | 15% |

EXAMPLE 2

The procedure of Example 1 was repeated in all essential details except the coupling agent used was a fatty acid and methylisobutyl ketone.

The amount of high grade oil shale in the feed was 33%. The following table summarizes the results.

| MATERIAL | OIL, gallons/ton (Average) | RECOVERY OF HIGH GRADE |
|---|---|---|
| Feed | 16 | |
| High Grade | 25 | 80% |
| Low Grade | 10 | |

The coupling agents of the present invention, comprising a carboxylic acid and a ketone, can be used in combination with a visible dye or pigment (e.g. carbon black) and utilizing the separation techniques described in Ser. No. 897,947 filed on the same day as the present application by Brij Moudgil, Booker Morey and David Messenger, titled "A Method of Separating a Mixture of Ore Particles", the entire disclosure of which is hereby incorporated herein.

What is claimed is:

1. A process for the separation of shale from a run of mine (ROM) shale containing particles of shale and refuse which comprises:

(a) conditioning the ROM shale with a coupling agent capable of selectively coating the carbonaceous matter in the particulate shale to the substantial exclusion of coating refuse, which coupling agent comprises at least one ketone and at least one carboxylic acid containing from about 5 to about 28 carbon atoms;

(b) causing a fluorescent dye to adhere to said coating of coupling agent in a quantity sufficient to make the coated particles of shale fluoresce upon excitation to a degree sufficient to distinguish the coated shale particles from the substantially non-coated refuse;

(c) exciting the fluorescent dye coupled to the shale particles to induce fluorescence; and (d) separating fluorescing, coated shale particles from substantially non-fluorescing, non-coated refuse particles.

2. The process of claim 1 wherein said coupling agent comprises a ketone and a carboxylic acid having from about 8 to about 14 carbon atoms.

3. The process of claim 1 wherein said ketone comprises methylisobutyl ketone.

4. The process of claim 1 wherein said carboxylic acid comprises oleic acid.

5. The process of claim 1 wherein said coupling agent comprises a mixture of oleic acid and methylisobutyl ketone dispersed in water.

6. The process of claim 1 wherein said fluorescent dye is an oil soluble dye.

7. The process of claim 6 wherein said fluorescent dye is fluoranthene.

8. The process of claim 1 wherein said fluorescent dye is combined with the coupling agent prior to the conditioning of the ROM shale.

9. The process of claim 1 wherein the ROM shale is conditioned with an aqueous dispersion comprising fluoranthene, oleic acid and methylisobutyl ketone.

10. The process of claim 1 wherein said fluorescent dye is combined with the coupling agent after the ROM shale has been conditioned with said coupling agent.

11. The process of claim 1 wherein said ROM shale is of a particle size of from about $\frac{1}{4}$ inch to about 8 inches.

12. The process of claim 11 wherein said ROM shale is of a particle size of from about $\frac{1}{2}$ inch to about 3 inches.

13. The process of claim 1 wherein the coupling agent is also a coloring agent.

14. A process for the separation of higher grade shale from lower grade shale and refuse, present in particulate run of the mine (ROM) shale said process comprising (a) conditioning particulate ROM shale by contacting the ROM shale with a mixture comprising a ketone and an organic carboxylic acid, said mixture being capable of selectively adhering to the kerogen in the ROM shale particles to the substantial exclusion of adhering to the refuse;

(b) causing a fluorescent dye to also adhere to the kerogen of the conditioned particles in a quantity sufficient to make the coated particles of shale fluoresce upon excitation to a degree sufficient to distinguish the conditioned higher grade shale from the conditioned lower grade shale and refuse;

(c) radiating fluorescence of the fluorescent conditioned particulate ROM shale to excite and induce sufficient fluoresc ence of the fluorescent dye to distinguish higher grade shale from lower grade shale and refuse; and (d) separating the fluorescing higher grade shale from the lesser fluorescing lower grade shale and the substantially non-fluorescing refuse.

* * * * *

UNITED STATES PATENT AND TRADEMARK OFFICE

CERTIFICATE OF CORRECTION

PATENT NO. : 4,169,045

DATED : September 25, 1979

INVENTOR(S) : Brij M. Moudgil et al.

It is certified that error appears in the above—identified patent and that said Letters Patent is hereby corrected as shown below:

Column 1, line 52, "valve" should read -- hand --.

Column 1, line 55, "oil", second occurrence, should read -- value --.

Column 6, line 18, "particles," should read -- particles. --.

Column 8, line 26, "fluorescence of" and "fluorescent" should be deleted.

Column 8, line 28, "fluoresc ence" should read -- fluorescence --.

Signed and Sealed this

*Twenty-second* Day of *January 1980*

[SEAL]

*Attest:*

SIDNEY A. DIAMOND

*Attesting Officer*

*Commissioner of Patents and Trademarks*